US009352588B1

(12) United States Patent
Boland et al.

(10) Patent No.: US 9,352,588 B1
(45) Date of Patent: May 31, 2016

(54) ADJUSTABLE ENERGY SOURCE WITHIN A DRUM DRYER OF A PRINT SYSTEM

(71) Applicants: Stuart J. Boland, Denver, CO (US); Dilan Nirushan Fernando, Thornton, CO (US); Scott R. Johnson, Erie, CO (US)

(72) Inventors: Stuart J. Boland, Denver, CO (US); Dilan Nirushan Fernando, Thornton, CO (US); Scott R. Johnson, Erie, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/677,351

(22) Filed: Apr. 2, 2015

(51) Int. Cl.
*B41J 2/225* (2006.01)
*B41J 11/00* (2006.01)

(52) U.S. Cl.
CPC ..... *B41J 11/002* (2013.01)

(58) Field of Classification Search
CPC ..... B41J 11/002; B41J 2/01; B41J 11/007; B41J 29/377
See application file for complete search history.

(56) References Cited

U.S. PATENT DOCUMENTS 5,595,118 A 1/1997 Villaverde et al.
6,698,958 B2 3/2004 Emery et al.
7,600,867 B2 10/2009 Mills et al.
7,868,272 B2 1/2011 Yokota et al.
8,026,034 B2 9/2011 Regan et al.
8,534,826 B2 * 9/2013 Kobayashi ..... B41J 2/155 347/101
8,628,188 B2 * 1/2014 Tokisawa ..... B41J 3/60 101/488
8,684,514 B1 * 4/2014 Priebe ..... B41J 11/002 347/102
2008/0257186 A1 10/2008 Kusaka

FOREIGN PATENT DOCUMENTS

GB 980625 1/1965

* cited by examiner

*Primary Examiner* — Lamson Nguyen
(74) *Attorney, Agent, or Firm* — Duft Bornsen & Fettig LLP

(57) ABSTRACT

Systems and methods for collapsible energy source in a drum dryer of a print system. One system includes a dryer with a thermally conductive drum to dry a colorant applied to a web of print media in contact with the drum. A radiant energy source disposed inside the drum includes segments that transfer heat to a surface of the drum. Each segment is attached to another segment about a hinge that allows the segments to pivot with respect to one another. A movement mechanism applies a force to the radiant energy source toward a center of the drum to cause the segments to pivot to a folded position with respect to one another, and applies a force to the radiant energy source toward the surface of the drum to cause the segments to pivot to expand with respect to a circumferential direction of the drum.

20 Claims, 6 Drawing Sheets

ADJUSTABLE ENERGY SOURCE WITHIN A DRUM DRYER OF A PRINT SYSTEM

FIELD OF THE INVENTION

The invention relates to the field of printing systems, and in particular, to print drying systems.

BACKGROUND

Businesses or other entities having a need for volume printing typically use a production printer capable of printing hundreds of pages per minute. A web of print media, such as paper, is stored the form of a large roll and unraveled as a continuous sheet. During printing, the web is quickly passed underneath printheads which discharge small drops of ink at particular intervals to form pixel images on the web. The web may then be dried and cut to produce a printed product.

Since production printers print high quality images at high speed, it is important that the drying process of the web is quick but effective. One such drying mechanism is a hollow metal drum heated with a radiant energy source inside the drum, such as a lamp. The lamp heats the surface of the drum to a desired temperature and the web contacts the heated surface as it travels in a rotating direction of the drum. The heated surface of the drum dries the ink on the web at a controlled temperature. However, since the lamps are located at fixed position within the drum, the drying process yields efficiency losses due to the fixed distance from the lamp to the surface of the drum. Moreover, it is difficult to access fixed lamps within the drum for service and maintenance operations, particularly when the lamps are not located near a central core of the drum.

SUMMARY

Embodiments described herein provide for an adjustable energy source within a dryer of a print system. The energy source is disposed inside a drum for drying a web of printed media in contact with the drum. The energy source may be comprised of independently movable segments. The segments may be moved toward a central axis of the drum for improved maintenance access. The segments may also include reflector backings and be moved in the opposite direction away from the central position of the drum (i.e., toward an inner surface of the drum) to improve heating efficiency during drying operation of the drum.

One embodiment is an apparatus comprising a dryer that includes a thermally conductive drum to dry a colorant applied to a web of print media in contact with the drum. The dryer also includes a radiant energy source disposed inside the drum. The radiant energy source is comprised of segments that transfer heat to a surface of the drum. Each segment is attached to another segment about a hinge that allows the segments to pivot with respect to one another. The dryer also includes a movement mechanism that applies a force to the radiant energy source toward a center of the drum to cause the segments to pivot to a folded position with respect to one another. The movement mechanism also applies a force to the radiant energy source toward the surface of the drum to cause the segments to pivot to expand with respect to a circumferential direction of the drum.

Another embodiment is a drum with a thermally conductive surface that rotates and dries a web marked with ink. The drum includes heated panels disposed inside the drum having joined segments, and a lamp on each joined segment, the lamp having a tubular body that extends parallel to an axis of the drum. Each heated panel is configured to move in a radial direction of the drum between a first position near the surface of the drum and a second position near a central axis of the drum. When the heated panels are moved to the first position, the joined segments of each heated panel forms a portion of a circumference that corresponds with the surface of the drum, and the heated panels collectively form a continuous heated surface along the circumference.

Yet another embodiment is apparatus that includes a hollow drum configured to conduct heat, and a segmented heat source inside the drum. Far ends of two of the segments are configured to move toward each other into a collapsed position and to move away from each other into an expanded position. An outer surface of the segments form a shape that corresponds with a surface of the drum when the far ends of two of the segments are in the expanded position.

The above summary provides a basic understanding of some aspects of the specification. This summary is not an extensive overview of the specification. It is not intended to identify key or critical elements of the specification nor to delineate any scope of particular embodiments of the specification, or any scope of the claims. Its sole purpose is to present some concepts of the specification in a simplified form as a prelude to the more detailed description that is presented later. The features, functions, and advantages that have been discussed can be achieved independently in various embodiments or may be combined in yet other embodiments, further details of which can be seen with reference to the following description and drawings.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
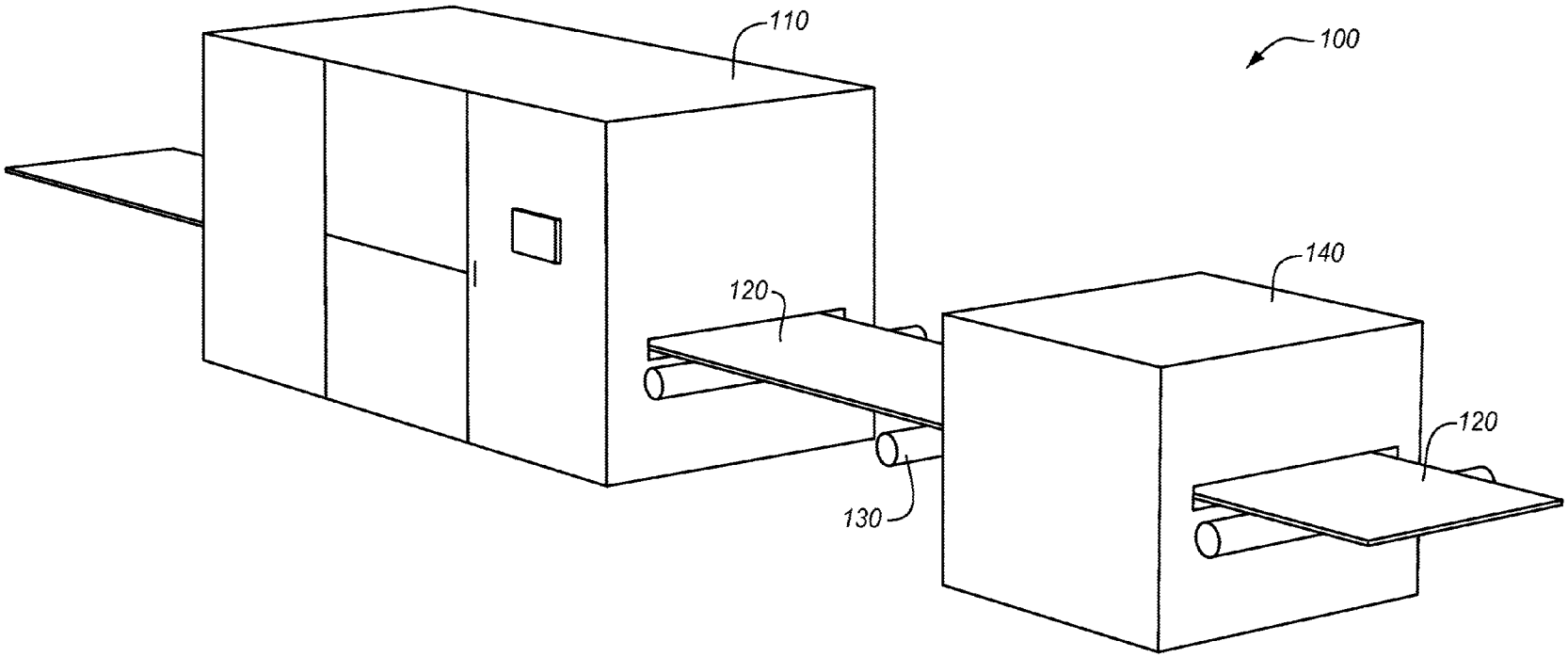
FIG. 1 illustrates an exemplary continuous-forms printing system.

FIG. 1 illustrates an exemplary continuous-forms printing system 100. Printing system 100 includes production printer 110, which is configured to apply ink onto a web 120 of continuous-form print media (e.g., paper). As used herein, the word "ink" is used to refer to any suitable marking fluid (e.g., aqueous inks, oil-based paints, etc.). Printer 110 may comprise an inkjet printer that applies colored inks, such as Cyan (C), Magenta (M), Yellow (Y), Key (K) black, white, or colorless inks. The ink applied by printer 110 onto web 120 is wet, meaning that the ink may smear if it is not dried before further processing. One or more rollers 130 position web 120 as it travels through printing system 100. Printing system 100 also includes drying system 140, which is any system, apparatus, device, or component operable to dry ink applied to web 120. Drying system 140 may be internal to the printer or a stand-alone external drying system.

Figure 2:
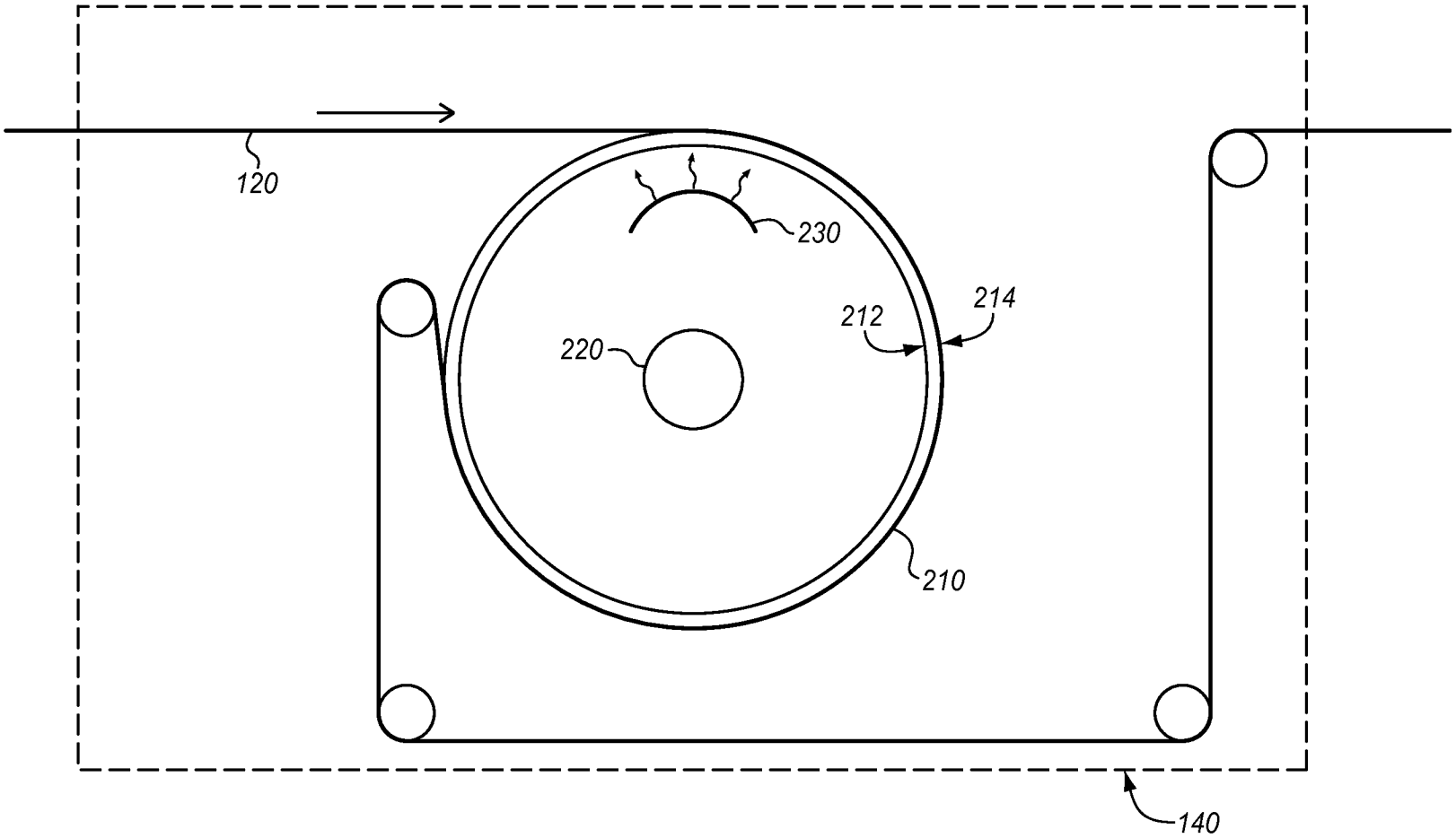
FIG. 2 illustrates a drying system in an exemplary embodiment.

FIG. 2 illustrates a drying system 140 in an exemplary embodiment. Drying system 140 includes a thermally conductive drum 210 and a radiant energy source 230 disposed inside drum 210. Drum 210 is hollow and thus includes an inner surface 212 and an outer surface 214. Drum 210 also includes a maintenance area 220 that is an area inside drum 210 that extends in a direction parallel to the axis of drum 210, also referred to herein as a lateral direction. In one embodiment, maintenance area 220 is an opening that extends along a central axis of drum 210 that allows access to internal components inside drum 210 for maintenance and service operations.

During operation, web 120 is marked with ink by a print engine, enters drying system 140, and wraps around outer surface 214 of drum 210, which rotates and is heated to a desired temperature via heat transfer of radiant energy source 230. Radiant energy source 230 is any system, component, device, or combination thereof operable to radiate heat to drum 210. One example of radiant energy source 230 is an array of heat lamps that emit infrared (IR) or near-infrared (NIR) energy and heat.

In conventional drum dryers, the heat source is located at a fixed position in the drum. If disposed at a fixed position close to the inner surface of the drum, the heat source is difficult to access for wiring or service operations from the central axis of the drum. Furthermore, if the heat source is positioned closer to a central area of the drum, there is no room to couple the heat source with reflector backings which may help keep the central area of the drum cooler for maintenance operations.

Figure 3:
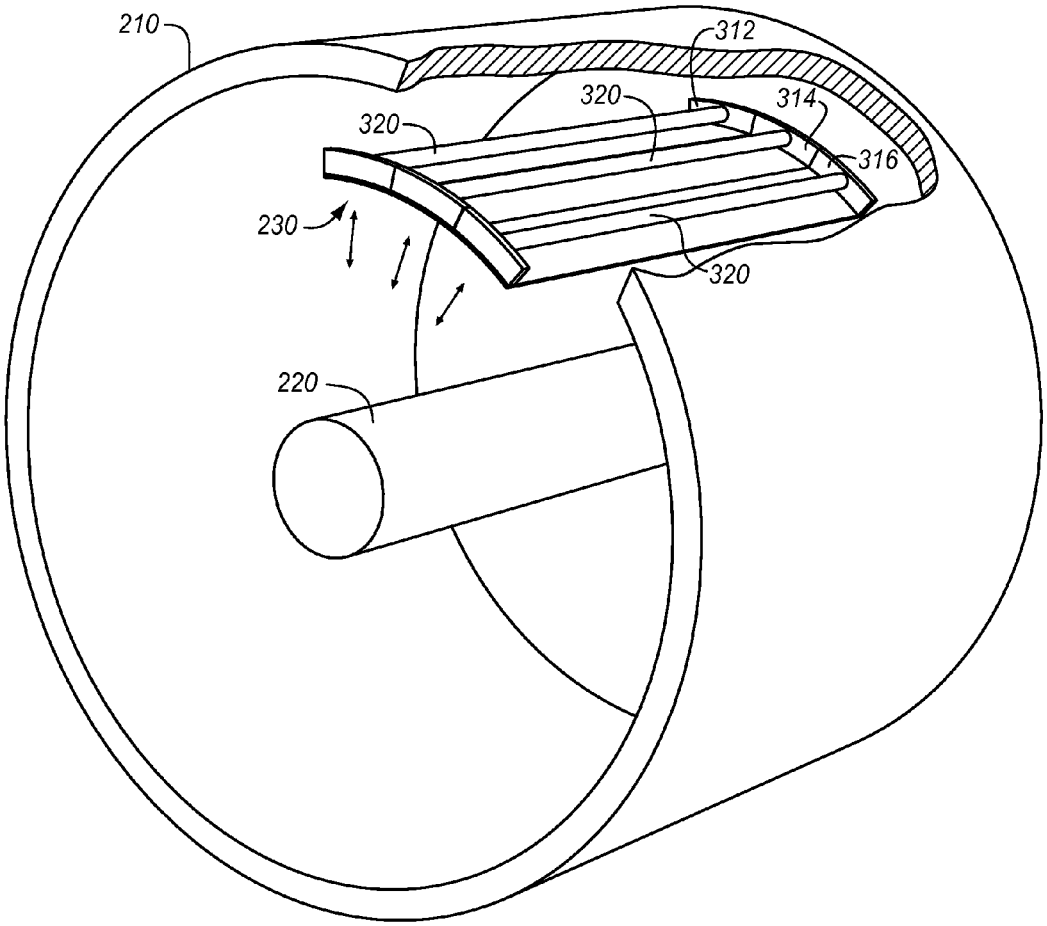
FIG. 3 illustrates a perspective view of a segmented radiant energy source in an exemplary embodiment.

Radiant energy source 230 is therefore enhanced to comprise independently movable segments. FIG. 3 illustrates a segmented radiant energy source 230 in an exemplary embodiment. Radiant energy source 230 comprises segments 312-316 operable to move independently from one another within the hollow space of drum 210. Each Segment 312-316 includes a heat source 320, such as a lamp with a tubular body that extends in a direction parallel with a rotation axis of drum 210.

Segments 312-316 of radiant energy source 230 may be independently or collectively moved radially inside drum 210 (e.g., towards and away the rotational axis of drum 210). As such, radiant energy source 230 and/or portions thereof may be adjusted a distance with respect to inner surface 212 of drum 210 for a corresponding adjustment in drying temperature. Moreover, one or more segments 312-316 may be moved toward maintenance area 220 when a maintenance procedure is to be performed on radiant energy source 230.

Figure 4:
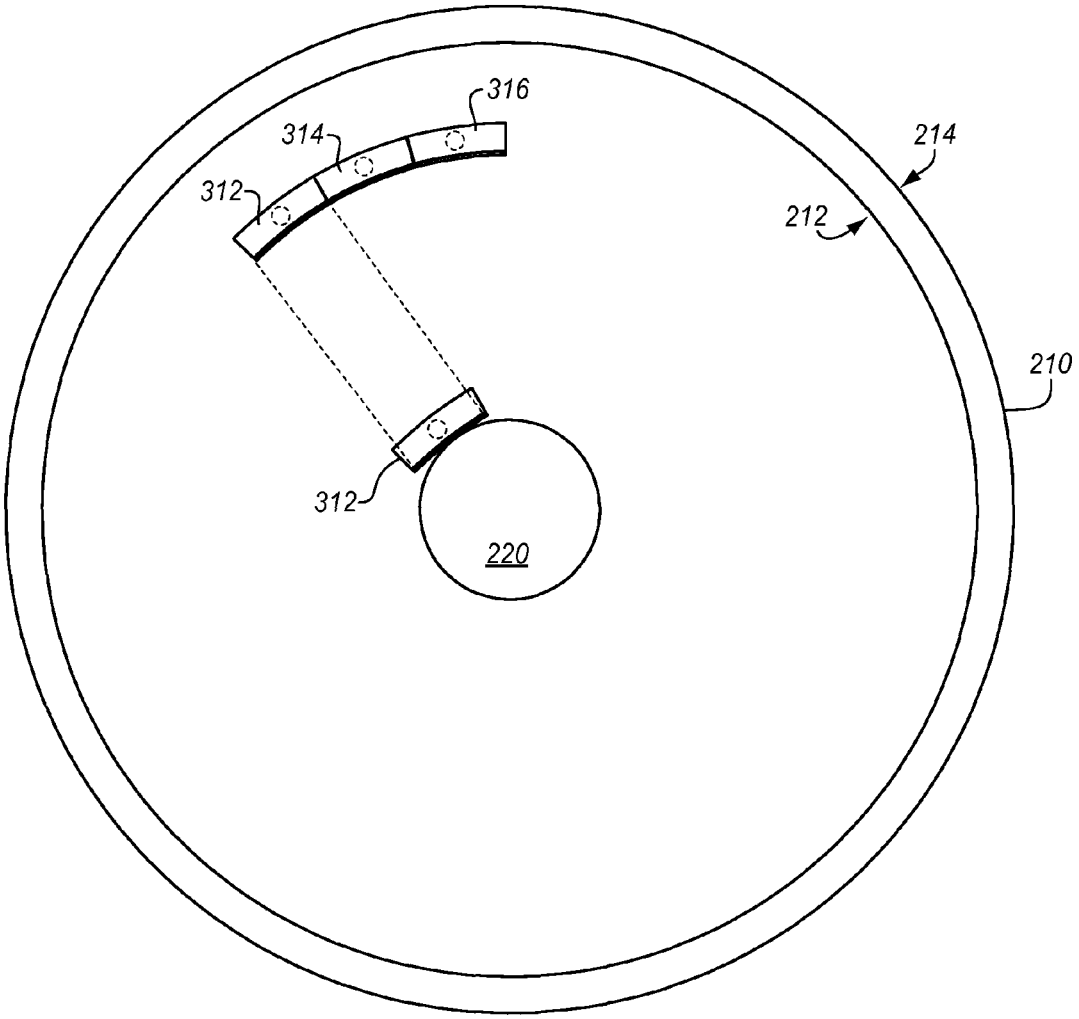
FIG. 4 illustrates a side view of a segmented radiant energy source in an exemplary embodiment.

FIG. 4 illustrates a side view of a segmented radiant energy source 230 in an exemplary embodiment. Segments 312-316 may be detachably coupled to one another for independent radial movement as described above. In this example, segment 312 may be detached from its adjacent segment 314 and moved toward maintenance area 220 for service. When coupled, adjacent segments 312-316 form a continuous surface that extends or expands in a circumferential direction inside drum 210 for efficient heating of drum 210.

Figure 5:
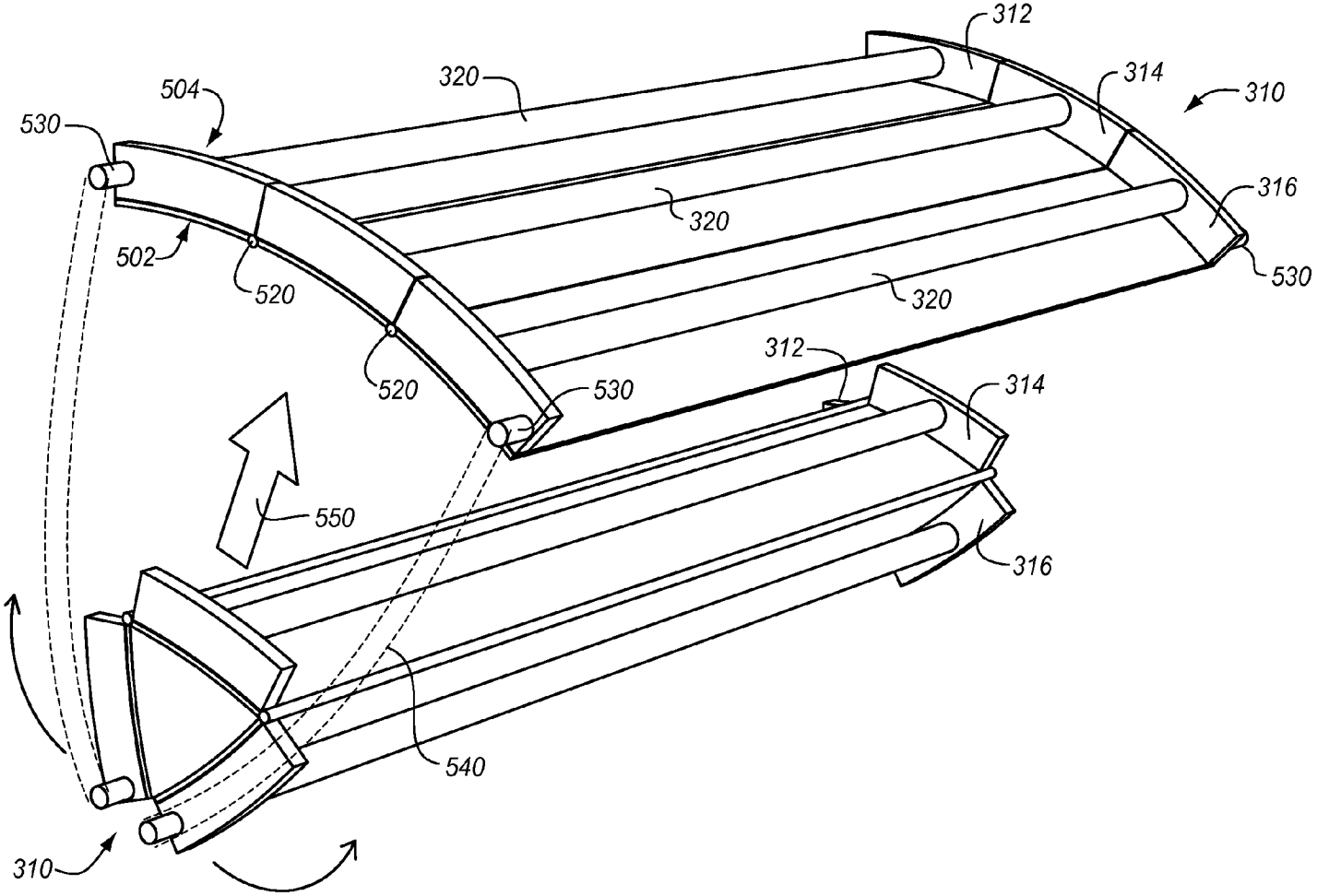
FIG. 5 illustrates a perspective view of a collapsible radiant energy source in an exemplary embodiment.

FIG. 5 is a perspective view of a collapsible radiant energy source 230 in an exemplary embodiment. Radiant energy source 230 comprises one or more panels 310 which may be independently or collectively moved radially inside drum 210. Panel 310 comprises segments 312-316 and each segment 312-316 includes a heat source 320 to radiate heat from an outer surface 504 of panel 310 toward and inner surface 212 of drum 210.

One or more panels 310 of radiant energy source 230 may include an inner surface 502 with a reflective material that is operable to reflect radiated energy towards inner surface 212 of drum 210 and away from maintenance area 220 of drum 210. The reflective material may be attached to one or more segments 312-316 on surfaces which face the center core of drum 210 when segments 312-316 are in an expanded position. Alternatively or additionally, the reflective material may be generally disposed between heat sources 230 and maintenance area 220 of drum 210. Thus, areas near maintenance area 220 of drum 210 where service/maintenance procedures may be performed may be prevented from reaching high temperatures as a result of the heat protection of the reflective material as drying system 140 operates. Furthermore, mechanical components such as ball bearings may also be prevented from reaching high temperatures.

Segments 312-316 are attached to one another about a hinge 520 that allows a segment 312-316 to pivot with respect to an adjacent segment 312-316 of panel 310. Segments 312-316 may alternatively or additionally be configured to fold or detach with respect to one another via other mechanisms. For example, segments 312-316 may be configured to slide within or around one another to collapse panel 310 and segments 312-316 may fan out to position panel 310 for heating operation.

Drying system 140 also includes a movement mechanism 550 operable to apply forces to panel 310 along a radial direction inside drum 210. Examples of movement mechanism 550 include, but is not limited to, a pneumatic device, a hydraulic device, a motor, an electric linear actuator, etc. In one embodiment, movement mechanism 550 comprises a gear, such as a worm gear, that rotates under motorized or manual force and transfers its rotational energy to a threaded rod that extends radially within drum 210. The rod thus applies radial forces to panel 310 and may be detachably coupled to a location of panel 310 such as hinge 520 and/or guide pin 530.

One or more segments 312-316 (e.g., far end segments 312 and 316 of panel 310 which have only one adjacent segment in panel 310) may include respective guide pins 530 operable to slide along a path of a corresponding track 540 as movement mechanism 550 moves panel 310 in the radial direction. Guide pins 530 may protrude laterally from panel 310 (e.g., parallel with axis of drum) and move along respective tracks 540 in a direction orthogonal to the lateral protrusion of guide pins 530.

Tracks 540 generally form a path with a width that corresponds with a diameter of a guide pin 530 and which cause segments 312-316 to fold among one another when panel 310 is moved toward maintenance area 220 of drum 210 and to flare out when panel 310 is moved toward inner surface 212 of drum 210. Tracks 540 may form paths of various curvatures or shapes that control a path of movement for respective guide pins 530 when movement mechanism 550 applies a radial force to panel 310. In this example, guide pins 530 are located on far ends of segments 312/316 having one other adjacent segment in panel 310 (e.g., located at or near circumferential ends of panel 310 when panel 310 is extended with respect to a circumference of drum 210 for dryer operation). Segment 314, which has two adjacent segments (e.g., 312/316) does not include a guide pin 530, but attaches to segments 312/316 via hinges 520.

As a radial force is applied to panel 310 toward inner surface 212 of drum 210, tracks 540 cause the ends of segments 312/316 to flare out in a circumferential direction via the defined path of guide pins 530 along tracks 540. When a radial force is applied to panel 310 in the opposite direction, tracks 540 cause the ends of segments to 312/316 to fold panel 310 via the reverse path of guide pins 530 along tracks 540. In this example, panel 310 expands/collapses via a pair of tracks 540 that guide ends of panel 310 on one lateral side of panel 310. However, numerous configurations are possible, including a pair of tracks 540 on both lateral ends of panel 310 and alternative shapes and positions for any number of guide pins 530, tracks 540, segments 312-316, and panels 310.

Figure 6:
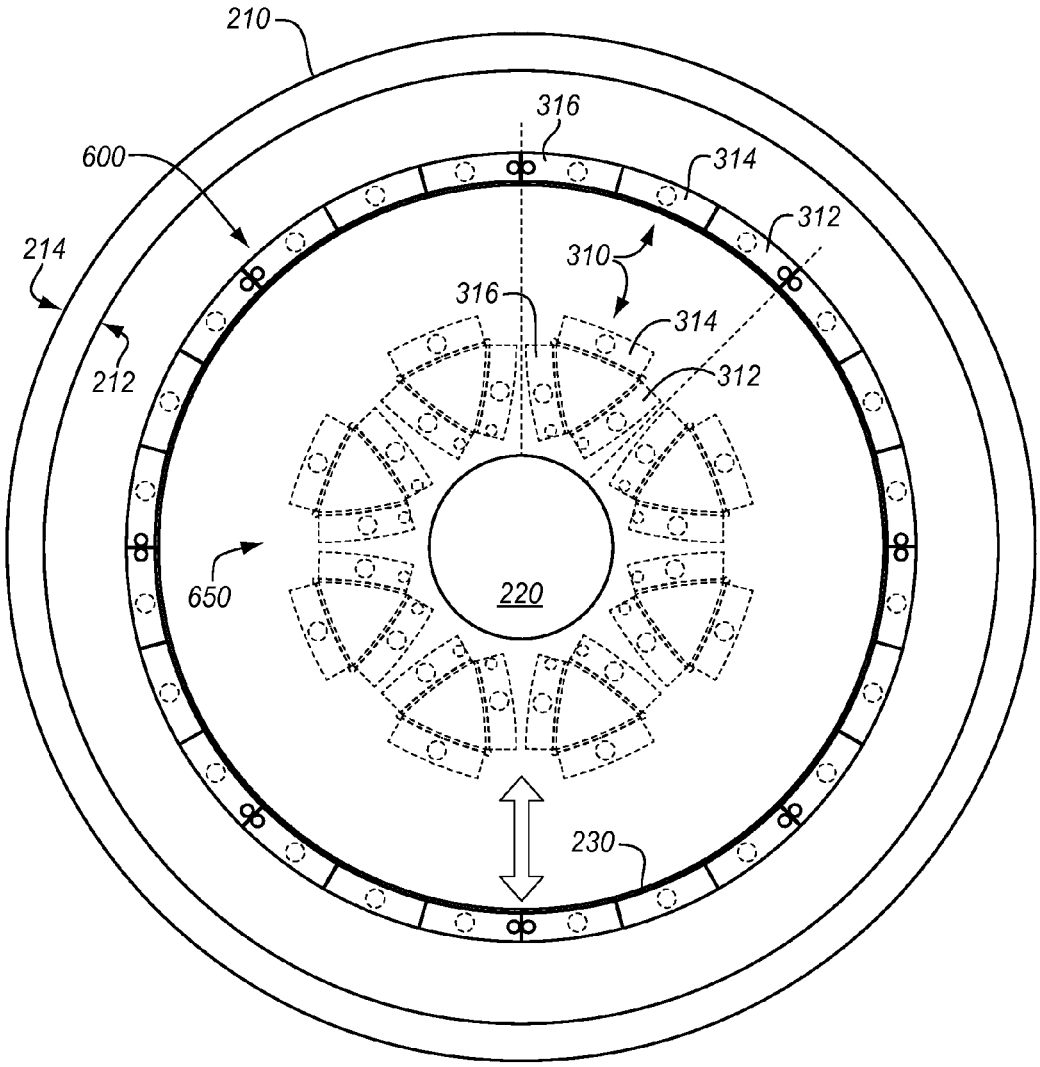
FIG. 6 illustrates a side view of a radiant energy source with a series of collapsible segments in an exemplary embodiment

FIG. 6 illustrates a side view of a radiant energy source with a series of collapsible segments in an exemplary embodiment. Radiant energy source 230 comprises multiple panels 310 operable to move in a radial direction within drum 210 and each panel 310 comprises multiple segments 312-316 operable to collapse/fold and expand/open with respect to one another. Though illustrated in this example with eight panels 310 each having three segments 312-316, energy source 230 may be comprised of any number of heat panels 310 and each panel 310 may be comprised of any number of segments 312-316.

During operation of drying system 140, radiant energy source 230 is positioned at operating position 600 such that panels 310 of radiant energy source 230 radiate heat toward inner surface 212 of drum 210 at a short distance. Furthermore, in operating position 600, segments 312-316 of each panel 310 extend from one another with respect to a circumferential direction of inner surface 212 of drum 210. The extended position of segments 312-316 and close proximity of panels 310 to inner surface 212 of drum 210 when energy source 230 is in operating position 600 enables efficient heating for drying system 140.

In one embodiment, an end segment of one panel 310 may contact or be in close proximity to an end segment of an adjacent panel 310 that is also in operating position 600. An individual panel 310 in the extended position forms a surface with a portion of a circumference which faces inner surface 212 of drum 210. Thus, panels 310 of energy source 230 in operating position 600 collectively form a continuous, or substantially continuous, circumference of heat inside drum 210 with a slightly smaller circumference than inner surface 212 of drum 210. Alternatively, one or more panels 310 may form a portion of a continuous circumference within drum 210 or multiple panels 310 may form a different continuous shape when radiant energy source 230 is in operating position 600. Each panel 310 may further include reflective material on respective inner surfaces 502 to prevent overheating maintenance area 220 of drum 210.

When drying system 140 is powered down (e.g., for maintenance procedures), heat sources 320 of panels 310 may be powered down and radiant energy source 230 moved in the radial direction away from inner surface 212 and toward maintenance area 220 of drum 210 until it reaches a collapsed position 650. When radiant energy source 230 is in collapsed position 650, panels 310 are close to or within maintenance area 220 for convenient access for maintenance of components inside drum 210. Furthermore, when radiant energy source 230 is in, or moved toward, collapsed position 650, segments 312-316 of each panel 310 fold or collapse with respect to one another. As a result, panels 310 may individually and/or collectively occupy a smaller space within drum 210 (e.g., each panel 310 decreases with respect to a circumferential direction of inner surface 212 of drum 210 in comparison to operational position 300) such that radiant energy source 230 surrounds or is near or within maintenance area 220 for maintenance procedures in collapsed position 650.

Drying system 140 may further include a controller operable to direct movement mechanism 550 to position panel 310 into operating position 600 or collapsed position 650. For example, printing system 100 and/or drying system 140 may include a graphical user interface (GUI) operable to receive input for adjusting a radial position of panel(s) 310 within drum 210. In one embodiment, controller is configured to direct one or more movement mechanisms 550 to move respective panels 310 radially toward inner surface 212 of drum 210 until panels 310 form a continuous circumference. Responsive to a maintenance position command, controller directs movement mechanisms 550 to move respective panels 310 radially away from inner surface 212 of drum 210 until panels 310 fold at a position within or near maintenance area 220 of drum 210.

Although specific embodiments were described herein, the scope of the inventive concepts is not limited to those specific embodiments. The scope of the inventive concepts is defined by the following claims and any equivalents thereof.

We claim:

1. An apparatus comprising:

a dryer comprising:

a thermally conductive drum configured to dry a colorant applied to a web of print media in contact with the drum;

a radiant energy source disposed inside the drum comprising:

segments configured to transfer heat to a surface of the drum, wherein each segment is attached to another segment about a hinge that allows the segments to pivot with respect to one another; and a movement mechanism configured to apply a force to the radiant energy source toward a center of the drum to cause the segments to pivot to a folded position with respect to one another, and to apply a force to the radiant energy source toward the surface of the drum to cause the segments to pivot to expand with respect to a circumferential direction of the drum.

2. The apparatus of claim 1 wherein the drum further comprises:

an opening in a lateral end of the drum that extends through a central axis of the drum in a lateral direction.

3. The apparatus of claim 2 wherein:

the movement mechanism is configured to pivot the segments to the folded position at a location near the opening, and to pivot the segments to expand at a location near the surface of the drum.

4. The apparatus of claim 3 wherein:

the movement mechanism comprises:

a shaft coupled to the radiant energy source, the shaft having a threaded portion;

a worm gear configured to interconnect with the threaded portion of the shaft; and a motor configured to drive the worm gear to apply the force to the radiant energy source along a radial direction of the drum.

5. The apparatus of claim 4, further comprising:

guide pins that protrude laterally from the segments; and tracks configured to form movement paths for respective guide pins;

wherein a curvature of the tracks cause the guide pins to pivot the segments about the hinge when the worm gear applies the force to the radiant energy source along the radial direction of the drum.

6. The apparatus of claim 4 further comprising:

a graphical user interface configured to receive operator input; and a controller configured to detect a command at the graphical user interface indicating a maintenance procedure is to be performed on the dryer, and to cause the motor to apply the force to the shaft via the worm gear responsive to the command.

7. The apparatus of claim 2 wherein:

each segment includes a lamp to radiate heat toward the surface of the drum; and each segment includes a reflective material to reflect radiated heat away from the central axis of the drum.

8. The apparatus of claim 7 wherein:

when the segments pivot to expand as a result of the force applied to the radiant toward the surface of the drum, the segments collectively form a continuous circumference inside the surface of the drum.

9. A drum with a thermally conductive surface that rotates and dries a web marked with ink, the drum comprising:

heated panels disposed inside the drum having joined segments; and a lamp on each joined segment, the lamp having a tubular body that extends parallel to an axis of the drum;

wherein each heated panel is configured to move in a radial direction of the drum between a first position near the surface of the drum and a second position near a central axis of the drum; and wherein when the heated panels are moved to the first position, the joined segments of each heated panel forms a portion of a circumference that corresponds with the surface of the drum, and the heated panels collectively form a continuous heated surface along the circumference.

10. The drum of claim 9 wherein:

when the heated panels are moved to the second position, the joined segments of each heated panel are folded among one another.

11. The drum of claim 9 wherein the heated panels further comprise:

a reflective backing that reduces heat radiated from the lamps near the central axis of the drum.

12. The drum of claim 9 further comprising:

shafts coupled with the heated panels, each shaft having a threaded portion;

gears interconnected with threaded portions of the shafts, wherein the threaded portion of the shafts transfer a rotational force of the gears to a radial force to the heated panels.

13. The drum of claim 9 further comprising:

tracks disposed at either lateral side of drum, the tracks having one end near the central axis of the drum and another end near the surface of the drum;

wherein each heated panel includes a pin configured to guide the joined segments.

14. The drum of claim 13 wherein:

each heated panel includes pins configured to move in a path of a corresponding track, the track having a curvature that causes the pins to rotate the joined segments of each heated panel.

15. An apparatus comprising:

a hollow drum configured to conduct heat; and a segmented heat source inside the drum, wherein far ends of two of the segments are configured to move toward each other into a collapsed position and to move away from each other into an expanded position, wherein an outer surface of the segments form a shape that corresponds with a surface of the drum when the far ends of two of the segments are in the expanded position.

16. The apparatus of claim 15 further comprising:

a movement mechanism configured to move the segmented heat source toward the surface of the drum, and to move the segmented heat source away from the surface of the drum.

17. The apparatus of claim 16 wherein:

the movement mechanism comprises a gear mated with a corresponding threaded rod, the rod being coupled to one of the segments.

18. The apparatus of claim 17 wherein:

the segments are coupled via hinges.

19. The apparatus of claim 17 wherein:

the segmented heat source forms a circumference that corresponds with a circumference of the drum when each of the segments are in the expanded position.

20. The apparatus of claim 15 further comprising:

a reflective material coupled to the segmented heat source and configured to prevent high temperatures at an area near a center of the drum.

* * * * *